US008020642B2

(12) United States Patent
Lancaster et al.

(10) Patent No.: US 8,020,642 B2
(45) Date of Patent: Sep. 20, 2011

(54) POLYCRYSTALLINE DIAMOND ABRASIVE ELEMENTS

(76) Inventors: Brett Lancaster, Boksburg (ZA); Bronwyn Annette Roberts, Parkhurst (ZA); Imraan Parker, Cape Town (ZA); Klaus Tank, Johannesburg (ZA); Roy Derrick Achilles, Bedfordview (ZA); Clement David Van Der Riet, Edenglen (ZA)

( * ) Notice: Subject to any disclaimer, the term of this patent is extended or adjusted under 35 U.S.C. 154(b) by 175 days.

(21) Appl. No.: 10/558,491

(22) PCT Filed: May 27, 2004

(86) PCT No.: PCT/IB2004/001747

§ 371 (c)(1),
(2), (4) Date: Jan. 19, 2007

(87) PCT Pub. No.: WO2004/106003

PCT Pub. Date: Dec. 9, 2004

(65) Prior Publication Data

US 2007/0181348 A1 Aug. 9, 2007

(30) Foreign Application Priority Data

May 27, 2003 (ZA) ..... 2003/4096
Nov. 7, 2003 (ZA) ..... 2003/8698

(51) Int. Cl.
*E21B 10/36* (2006.01)

(52) U.S. Cl. ..... 175/432; 175/434; 175/433

(58) Field of Classification Search ..... 175/434, 175/432, 433; 76/108.2
See application file for complete search history.

(56) References Cited

U.S. PATENT DOCUMENTS 4,224,380 A 9/1980 Bovenkerk et al.
4,255,165 A 3/1981 Dennis et al.
4,572,722 A 2/1986 Dyer
4,604,106 A * 8/1986 Hall ..... 51/293
4,636,253 A 1/1987 Nakai et al.
4,690,691 A 9/1987 Komanduri
4,766,040 A 8/1988 Hillert et al.
4,861,350 A 8/1989 Phaal et al.
4,976,324 A 12/1990 Tibbetts (Continued)

FOREIGN PATENT DOCUMENTS

EP 0 196 777 10/1986

(Continued)

OTHER PUBLICATIONS

Declaration of Stephen C. Steinke, dated Jul. 21, 2008.
Field Trial Report for Smith Test Bits with Partially Leached Cutters Occurring on or before Dec. 22, 2003. (Confidential-can be obtained through U.S. Appl. No. 11/022,271).
Japanese Office Action dated Mar. 2, 2010 with partial English translation.

*Primary Examiner* — Kenneth Thompson
*Assistant Examiner* — Cathleen R Hutchins
(74) *Attorney, Agent, or Firm* — Scully, Scott, Murphy & Presser, P.C.

(57) ABSTRACT

A polycrystalline diamond abrasive element, particularly a cutting element, comprises a table of polycrystalline diamond bonded to a substrate, particularly a cemented carbide substrate, along a non-planar interface. The non-planar interface typically has a cruciform configuration. The polycrystalline diamond has a high wear-resistance, and has a region adjacent the working surface lean in catalysing material and a region rich in catalysing material. The region lean in catalysing material extends to a depth of 40 to 90 microns, which is much shallower than in the prior art. Notwithstanding the shallow region lean in catalysing material, the polycrystalline diamond cutters have a wear resistance, impact strength and cutter life comparable to that of prior art cutters, but requiring only 20% of the treatment times of the prior art cutters.

26 Claims, 5 Drawing Sheets

U.S. PATENT DOCUMENTS

| | | | | | |
|---|---|---|---|---|---|
| 5,011,514 | A | | 4/1991 | Cho et al. | |
| 5,127,923 | A | | 7/1992 | Bunting et al. | |
| 5,337,844 | A | | 8/1994 | Tibbitts | |
| 5,351,772 | A | | 10/1994 | Smith | |
| 5,468,268 | A | * | 11/1995 | Tank et al. | 51/293 |
| 5,486,137 | A | | 1/1996 | Flood et al. | |
| 5,505,748 | A | | 4/1996 | Tank et al. | |
| 5,560,716 | A | | 10/1996 | Tank et al. | |
| 5,645,617 | A | * | 7/1997 | Frushour | 51/309 |
| 5,667,028 | A | | 9/1997 | Truax et al. | |
| 5,711,702 | A | * | 1/1998 | Devlin | 451/540 |
| 5,935,323 | A | | 8/1999 | Tanga et al. | |
| 6,068,913 | A | | 5/2000 | Cho et al. | |
| 6,098,730 | A | | 8/2000 | Scott et al. | |
| 6,187,068 | B1 | | 2/2001 | Frushour et al. | |
| 6,202,771 | B1 | * | 3/2001 | Scott et al. | 175/432 |
| 6,315,652 | B1 | * | 11/2001 | Snyder et al. | 451/540 |
| 6,344,149 | B1 | | 2/2002 | Oles | |
| 6,481,511 | B2 | * | 11/2002 | Matthias et al. | 175/431 |
| 6,527,069 | B1 | * | 3/2003 | Meiners et al. | 175/432 |
| 6,544,308 | B2 | | 4/2003 | Griffin et al. | |
| 6,562,462 | B2 | * | 5/2003 | Griffin et al. | 428/408 |
| 6,601,662 | B2 | | 8/2003 | Matthias et al. | |
| D502,952 | S | * | 3/2005 | Achilles et al. | D15/139 |
| 6,933,049 | B2 | * | 8/2005 | Wan et al. | 428/408 |
| 7,048,081 | B2 | * | 5/2006 | Smith et al. | 175/434 |
| 2004/0140133 | A1 | * | 7/2004 | Liang | 175/428 |
| 2005/0139397 | A1 | | 6/2005 | Achilles et al. | |
| 2005/0263328 | A1 | | 12/2005 | Middlemiss | |
| 2006/0050392 | A1 | | 3/2006 | Schulz | |
| 2006/0060390 | A1 | | 3/2006 | Eyre | |
| 2006/0060391 | A1 | | 3/2006 | Eyre et al. | |
| 2006/0086540 | A1 | | 4/2006 | Griffin et al. | |
| 2006/0260850 | A1 | | 11/2006 | Roberts et al. | |
| 2008/0142267 | A1 | | 6/2008 | Griffin et al. | |
| 2008/0142275 | A1 | | 6/2008 | Griffin et al. | |

FOREIGN PATENT DOCUMENTS

| | | |
|---|---|---|
| EP | 1190791 | 3/2002 |
| GB | 2374618 | 10/2002 |
| JP | 59-219500 | 12/1984 |
| JP | 61-270496 | 11/1986 |
| JP | 05-004102 | 1/1993 |
| JP | 2000-096972 | 4/2000 |
| RU | 566439 | 1/2000 |
| RU | 2034937 | 9/2004 |
| WO | 93/23204 | 11/1993 |
| WO | 2004/106004 | 12/2004 |

* cited by examiner

POLYCRYSTALLINE DIAMOND ABRASIVE ELEMENTS

BACKGROUND OF THE INVENTION

This invention relates to polycrystalline diamond abrasive elements.

Polycrystalline diamond abrasive elements, also known as polycrystalline diamond compacts (PDC), comprise a layer of polycrystalline diamond (PCD) generally bonded to a cemented carbide substrate. Such abrasive elements are used in a wide variety of drilling, wear, cutting, drawing and other such applications. PCD abrasive elements are used, in particular, as cutting inserts or elements in drill bits.

Polycrystalline diamond is extremely hard and provides an excellent wear-resistant material. Generally, the wear resistance of the polycrystalline diamond increases with the packing density of the diamond particles and the degree of interparticle bonding. Wear resistance will also increase with structural homogeneity and a reduction in average diamond grain size. This increase in wear resistance is desirable in order to achieve better cutter life. However, as PCD material is made more wear resistant it typically becomes more brittle or prone to fracture. PCD elements designed for improved wear performance will therefore tend to have compromised or reduced resistance to spalling.

With spalling-type wear, the cutting efficiency of the cutting inserts can rapidly be reduced and consequently the rate of penetration of the drill bit into the formation is slowed. Once chipping begins, the amount of damage to the table continually increases, as a result of the increased normal force now required to achieve the required depth of cut. Therefore, as cutter damage occurs and the rate of penetration of the drill bit decreases, the response of increasing weight on bit can quickly lead to further degradation and ultimately catastrophic failure of the chipped cutting element.

JP 59-219500 teaches that the performance of PCD tools can be improved by removing a ferrous metal binding phase in a volume extending to a depth of at least 0.2 mm from the surface of a sintered diamond body.

A PCD cutting element has recently been introduced on to the market which is said to have greatly improved cutter life, by increasing wear resistance without loss of impact strength. U.S. Pat. Nos. 6,544,308 and 6,562,462 describe the manufacture and behaviour of such cutters. The PCD cutting element is characterised inter alia, by a region adjacent the cutting surface which is substantially free of catalysing material. Catalysing materials for polycrystalline diamond are generally transition metals such as cobalt or iron.

Typically the metallic phase is removed using an acid leaching or other similar chemical technology to dissolve out the metallic phase. Removal of the metallic phase can be very difficult to control and may result in damage to the highly vulnerable interface region between the PCD layer and the underlying carbide substrate. In addition, in many cases the substrate is more vulnerable to acid attack than the PCD table itself, and acid damage to the metallic phase in this component will render the cutter useless or highly compromised in the application. Masking technologies are employed to protect the majority of the PCD table (where leaching is not required) and the carbide substrate, but these are not always successful, especially under extended periods of treatment.

U.S. Pat. Nos. 6,544,308 and 6,562,462 teach that the most optimal response to leaching of the PCD layer is achieved where leach depths exceed 200 μm. The highly dense nature of the PCD typically treated requires extreme treatment conditions and/or time periods to achieve this depth of leach. In many cases the masking technologies available do not provide sufficient protection damage on all units undergoing the treatment.

In order to provide PCD abrasive elements with greater wear resistance than those claimed in the prior art previously discussed, it has been proposed to provide a mix of diamond particles, differing in their average particle size, in the manufacture of the PCD layers. U.S. Pat. Nos. 5,505,748 and 5,468,268 describe the manufacture of such PCD layers.

SUMMARY OF THE INVENTION

According to the present invention, there is provided a polycrystalline diamond abrasive element, particularly a cutting element, comprising a table of polycrystalline diamond having a working surface and bonded to a substrate, particularly a cemented carbide substrate, along an interface, the polycrystalline diamond abrasive element being characterised by:

i. the interface being non-planar;

ii. the polycrystalline diamond having a high wear-resistance; and iii. the polycrystalline diamond having a region adjacent the working surface lean in catalysing material and a region rich in catalysing material, the region lean in catalysing material extending to a depth of about 40 to about 90 μm from the working surface.

The polycrystalline diamond table may be in the form of a single layer, which has a high wear resistance. This may be achieved, and is preferably achieved, by producing the polycrystalline diamond from a mass of diamond particles having at least three, and preferably at least five different particle sizes. The diamond particles in this mix of diamond particles are preferably fine.

The average particle size of the layer of polycrystalline diamond is preferably less than 20 microns, although adjacent the working surface it is preferably less than about 15 microns. In polycrystalline diamond, individual diamond particles are, to a large extent, bonded to adjacent particles through diamond bridges or necks. The individual diamond particles retain their identity, or generally have different orientations. The average particle size of these individual diamond particles may be determined using image analysis techniques. Images are collected on the scanning electron microscope and are analysed using standard image analysis techniques. From these images, it is possible to extract a representative diamond particle size distribution for the sintered compact.

The table of polycrystalline diamond may have regions or layers which differ from each other in their initial mix of diamond particles. Thus, there is preferably a first layer containing particles having at least five different average particle sizes on a second layer which has particles having at least four different average particle sizes.

The polycrystalline diamond table has a region adjacent the working surface which is lean in catalysing material to a depth of about 40 to about 90 μm. Generally, this region will be substantially free of catalysing material.

The polycrystalline diamond table also has a region rich in catalysing material. The catalysing material is present as a sintering agent in the manufacture of the polycrystalline diamond table. Any diamond catalysing material known in the art may be used. Preferred catalysing materials are Group VIII transition metals such as cobalt and nickel. The region rich in catalysing material will generally have an interface with the region lean in catalysing material and extend to the interface with the substrate.

The region rich in catalysing material may itself comprise more than one region. The regions may differ in average particle size, as well as in chemical composition. These regions, when provided, will generally, but not exclusively, lie in planes parallel to the working surface of the polycrystalline diamond layer. In another example, the layers may be arranged perpendicular to the working surface, i.e., in concentric rings.

The polycrystalline diamond table typically has a maximum overall thickness of about 1 to about 3 mm, preferably about 2.2 mm as measured at the edge of the cutting tool. The PCD layer thickness will vary significantly below this throughout the body of the cutter as a function of the boundary with the non-planar interface The interface between the polycrystalline diamond table and the substrate is non-planar, and preferably has a cruciform configuration. The non-planar interface is characterised in one embodiment by having a step at the periphery of the abrasive element defining a ring which extends around at least a part of the periphery of the abrasive element and into the substrate and a cruciform recess that extends into the substrate and intersecting the peripheral ring. In particular, the cruciform recess is cut into an upper surface of the substrate and a base surface of the peripheral ring.

In an alternative embodiment, the non-planar interface is characterised by having a step at the periphery of the abrasive element defining a ring which extends around at least a part of the periphery of the abrasive element and into the substrate and a cruciform recess that extends into the substrate and is confined within the bounds of the step defining the peripheral ring. Further, the peripheral ring includes a plurality of indentations in a base surface thereof, each indentation being located adjacent respective ends of the cruciform recess.

According to another aspect of the invention, a method of producing a PCD abrasive element as described above includes the steps of creating an unbonded assembly by providing a substrate having a non-planar surface, placing a mass of diamond particles on the non-planar surface, the mass of diamond particles containing particles having at least three, and preferably at least five, different average particle sizes, providing a source of catalysing material for the diamond particles, subjecting the unbonded assembly to conditions of elevated temperature and pressure suitable for producing a polycrystalline diamond table of the mass of diamond particles, such table being bonded to the non-planar surface of the substrate, and removing catalysing material from a region of the polycrystalline diamond table adjacent an exposed surface thereof to a depth of about 40 to about 90 μm.

The substrate will generally be a cemented carbide substrate. The source of catalysing material will generally be the cemented carbide substrate. Some additional catalysing material may be mixed in with the diamond particles.

The diamond particles contain particles having different average particle sizes. The term "average particle size" means that a major amount of particles will be close to the particle size, although there will be some particles above and some particles below the specified size.

Catalysing material is removed from a region of the polycrystalline diamond table adjacent to an exposed surface thereof. Generally, that surface will be on a side of the polycrystalline diamond table opposite to the non-planar surface and will provide a working surface for the polycrystalline diamond table. Removal of the catalysing material may be carried out using methods known in the art such as electrolytic etching and acid leaching.

The conditions of elevated temperature and pressure necessary to produce the polycrystalline diamond table from a mass of diamond particles are well known in the art. Typically, these conditions are pressures in the range 4 to 8 GPa and temperatures in the range 1300 to 1700° C.

Further according to the invention, there is provided a rotary drill bit containing a plurality of cutter elements, substantially all of which are PCD abrasive elements, as described above.

It has been found that the PCD abrasive elements of the invention have a wear resistance, impact strength and hence cutter life comparable to that of PCD abrasive elements of the prior art, whilst requiring only roughly 20% of the treatment time required by the prior art PCD abrasive elements for removing catalysing material from the PCD layer.

DETAILED DESCRIPTION OF THE INVENTION

The polycrystalline diamond abrasive elements of the invention have particular application as cutter elements for drill bits. In this application, they have been found to have excellent wear resistance and impact strength. These properties allow them to be used effectively in drilling or boring of subterranean formations having high compressive strength.

Figure 1:
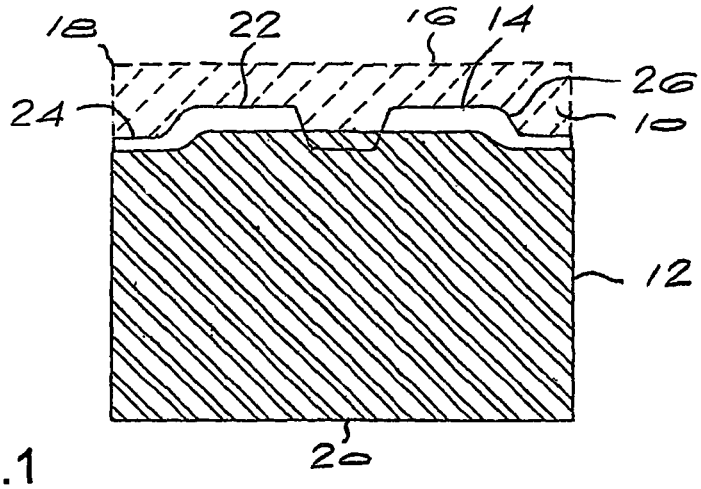
FIG. 1 is a sectional side view of a first embodiment of a polycrystalline diamond abrasive element of the invention.
Figure 2:
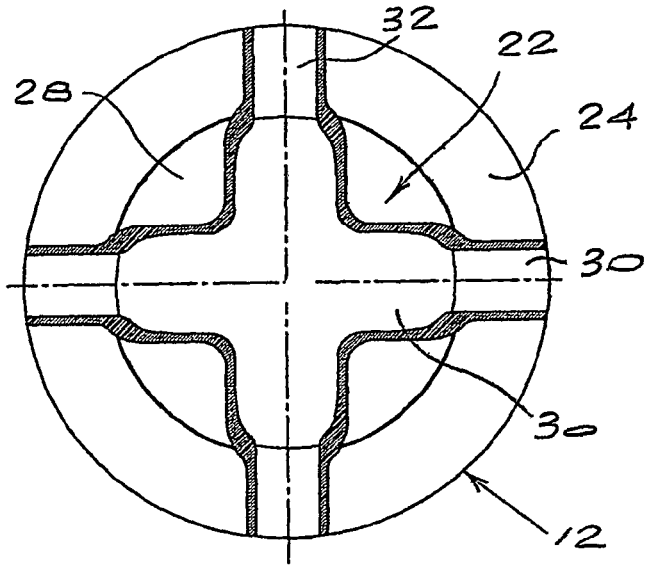
FIG. 2 is a plan view of the cemented carbide substrate of the polycrystalline diamond abrasive element of FIG. 1.
Figure 3:
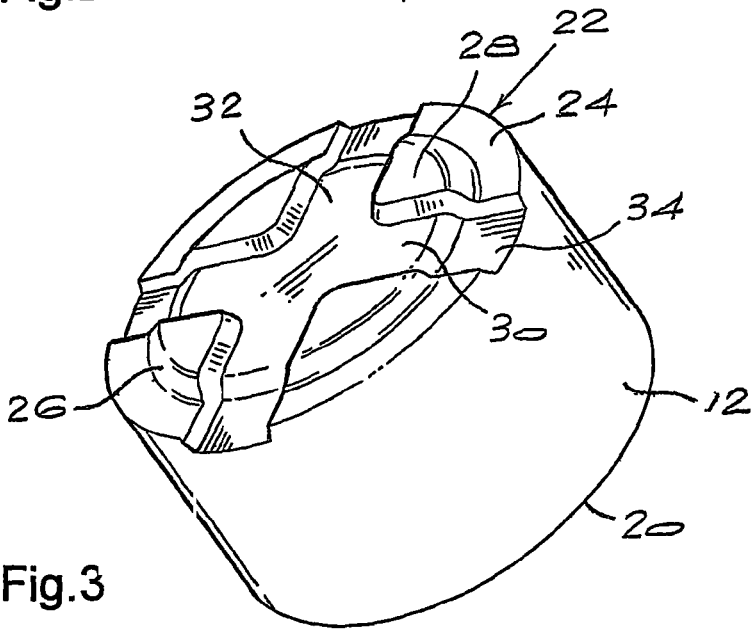
FIG. 3 is a perspective view of the cemented carbide substrate of the polycrystalline diamond abrasive element of FIG. 1.
Figure 4:
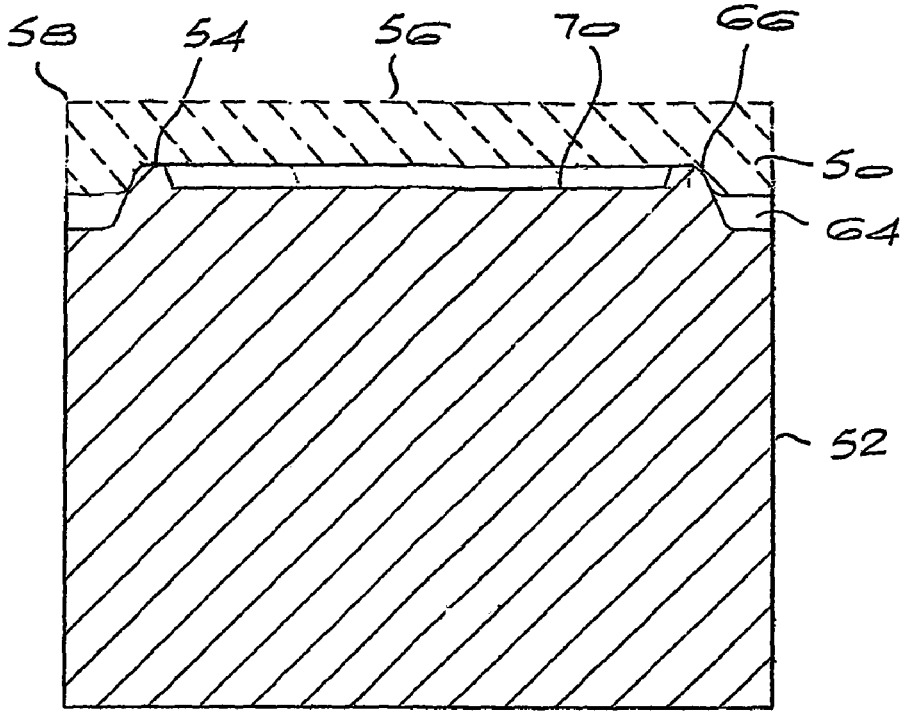
FIG. 4 is a sectional side view of a second embodiment of a polycrystalline diamond abrasive element of the invention.
Figure 5:
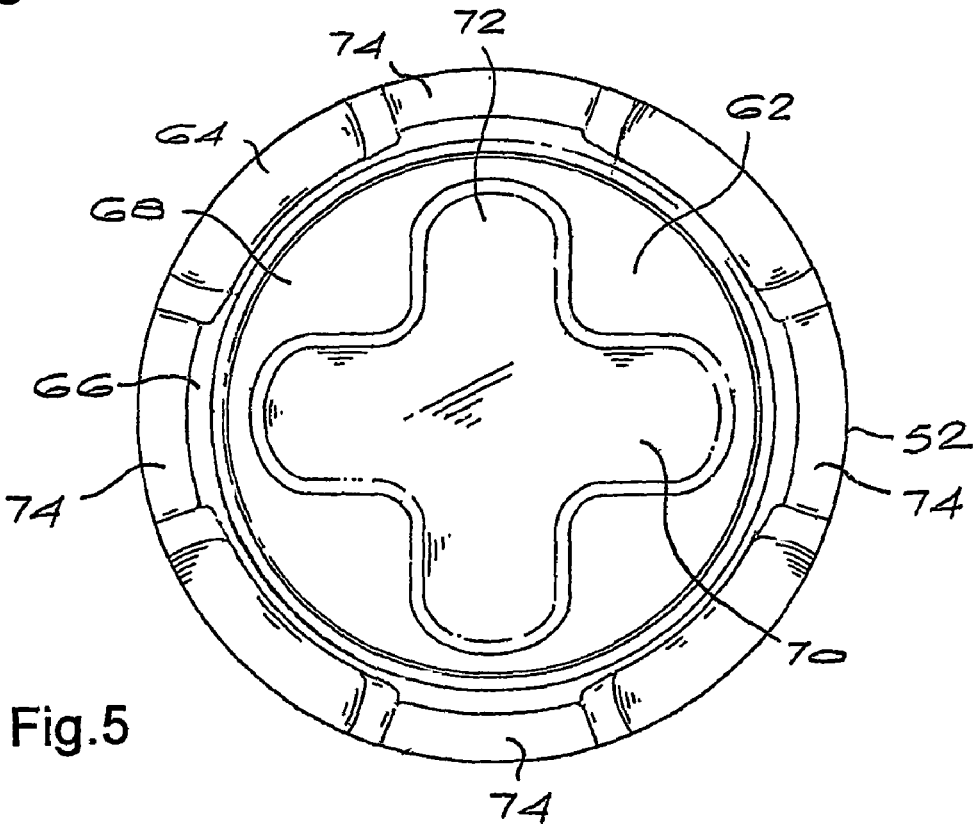
FIG. 5 is a plan view of the cemented carbide substrate of the polycrystalline diamond abrasive element of FIG. 4.
Figure 6:
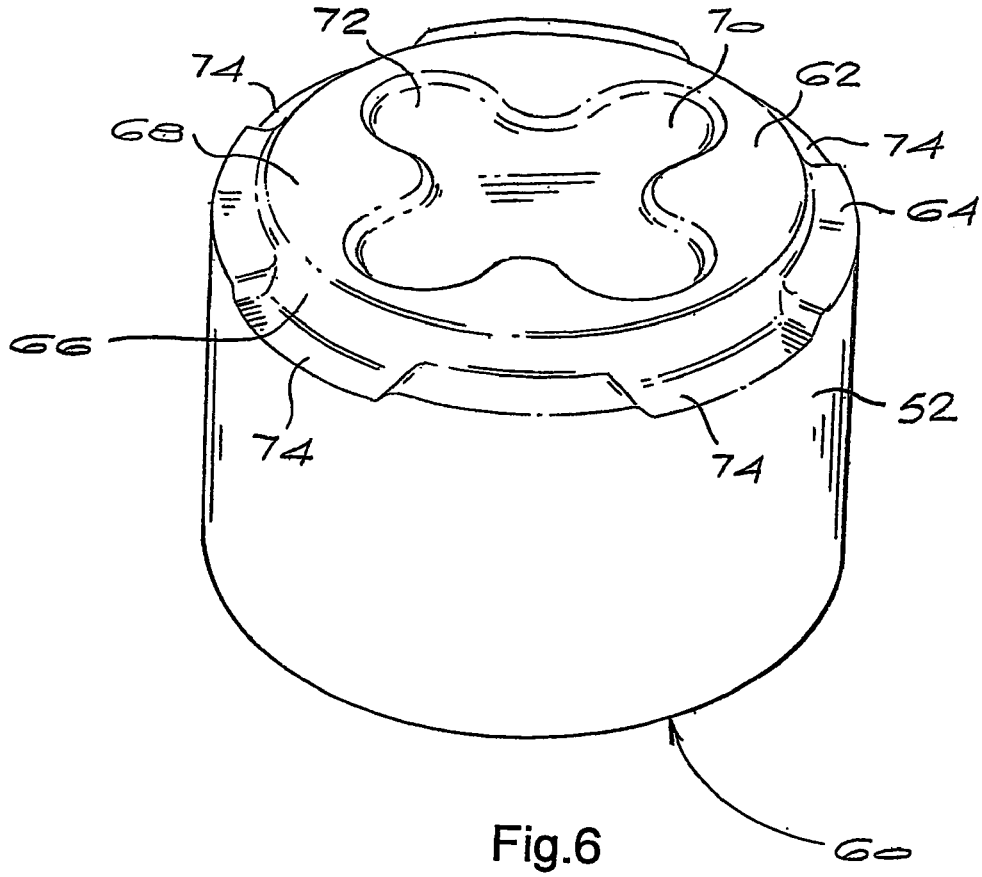
FIG. 6 is a perspective view of the cemented carbide substrate of the polycrystalline diamond abrasive element of FIG. 4.

Embodiments of the invention will now be described. FIGS. 1 to 3 illustrate a first embodiment of a polycrystalline diamond abrasive element of the invention and FIGS. 4 to 6 illustrate a second embodiment thereof. In these embodiments, a layer of polycrystalline diamond is bonded to a cemented carbide substrate along a non-planar or profiled interface.

Referring first to FIG. 1, a polycrystalline diamond abrasive element comprises a layer 10 of polycrystalline diamond (shown in phantom lines) bonded to a cemented carbide substrate 12 along an interface 14. The polycrystalline diamond layer 10 has an upper working surface 16 which has a cutting edge 18. The edge is illustrated as being a sharp edge. This edge can also be bevelled. The cutting edge 18 extends around the entire periphery of the surface 16.

FIGS. 2 and 3 illustrate more clearly the cemented carbide substrate used in the first embodiment of the invention shown in FIG. 1. The substrate 12 has a flat bottom surface 20 and a profiled upper surface 22, which generally has a cruciform configuration. The profiled upper surface 22 has the following features:

i. A stepped peripheral region defining a ring 24. The ring 24 has a sloping surface 26 which connects an upper flat surface or region 28 of the profiled surface 22.

ii. Two intersecting grooves 30, 32, which define a cruciform recess, that extend from one side of the substrate to the opposite side of the substrate. These grooves are cut through the upper surface 28 and also through the base surface 34 of the ring 24.

Referring now to FIG. 4, a polycrystalline diamond abrasive element of a second embodiment of the invention comprises a layer 50 of polycrystalline diamond (shown in phantom lines) bonded to a cemented carbide substrate 52 along an interface 54. The polycrystalline diamond layer 50 has an upper working surface 56, which has a cutting edge 58. The edge is illustrated as being a sharp edge. This edge can also be bevelled. The cutting edge 58 extends around the entire periphery of the surface 56.

FIGS. 5 and 6 illustrate more clearly the cemented carbide substrate used in the second embodiment of the invention, as shown in FIG. 4. The substrate 52 has a flat bottom surface 60 and a profiled upper surface 62. The profiled upper surface 62 has the following features:

i. A stepped peripheral region defining a ring 64. The ring 64 has a sloping surface 66 which connects an upper flat surface or region 68 of the profiled surface.

ii. Two intersecting grooves 70, 72 forming a cruciform formation in the surface 68.

iii. Four cut-outs or indentations 74 in the ring 64 located opposite respective ends of the grooves 70, 72.

In the embodiments of FIGS. 1 to 6, the polycrystalline diamond layers 10, 50 have a region rich in catalysing material and a region lean in catalysing material. The region lean in catalysing material will extend from the respective working surface 16, 56 into the layer 10, 50 to a depth of about 60 to 90 μm, which forms the crux of the invention. Typically, if the PCD edge is bevelled, the region lean in catalysing material will generally follow the shape of this bevel and extend along the length of the bevel. The balance of the polycrystalline diamond layer 10, 50 extending to the profiled surface 22, 62 of the cemented carbide substrate 12, 52 will be the region rich in catalysing material.

Generally, the layer of polycrystalline diamond will be produced and bonded to the cemented carbide substrate by methods known in the art. Thereafter, catalysing material is removed from the working surface of the particular embodiment using any one of a number of known methods. One such method is the use of a hot mineral acid leach, for example a hot hydrochloric acid leach. Typically, the temperature of the acid will be about 110° C. and the leaching times will be about 5 hours. The area of the polycrystalline diamond layer which is intended not to be leached and the carbide substrate will be suitably masked with acid resistant material.

In producing the polycrystalline diamond abrasive elements described above, and as illustrated in the preferred embodiments, a layer of diamond particles, optionally mixed with some catalysing material, will be placed on the profiled surface of a cemented carbide substrate. This unbonded assembly is then subjected to elevated temperature and pressure conditions to produce polycrystalline diamond of the diamond particles bonded to the cemented carbide substrate. The conditions and steps required to achieve this are well known in the art.

The diamond layer will comprise a mix of diamond particles, differing in average particle sizes. In one embodiment, the mix comprises particles having five different average particle sizes as follows:

| Average Particle Size (in microns) | Percent by mass |
|---|---|
| 20 to 25 (preferably 22) | 25 to 30 (preferably 28) |
| 10 to 15 (preferably 12) | 40 to 50 (preferably 44) |
| 5 to 8 (preferably 6) | 5 to 10. (preferably 7) |
| 3 to 5 (preferably 4) | 15 to 20 (preferably 16) |
| less than 4 (preferably 2) | Less than 8 (preferably 5) |

In a particularly preferred embodiment, the polycrystalline diamond layer comprises two layers differing in their mix of particles. The first layer, adjacent the working surface, has a mix of particles of the type described above. The second layer, located between the first layer and the profiled surface of the substrate, is one in which (i) the majority of the particles have an average particle size in the range 10 to 100 microns, and consists of at least three different average particle sizes and (ii) at least 4 percent by mass of particles have an average particle size of less than 10 microns. Both the diamond mixes for the first and second layers may also contain admixed catalyst material.

A polycrystalline diamond element was produced, using a cemented carbide substrate having a profiled surface substantially as illustrated by FIGS. 1 to 3. The diamond mix used in producing the polycrystalline diamond table in this embodiment consisted of two layers. The mix of particles in the two layers was as described in respect of the particularly preferred embodiment above, and had a general thickness of about 2.2 mm. The average overall diamond particle size, in the polycrystalline diamond layer, was found to be 15 μm after sintering. This polycrystalline diamond cutter element will be designated "Cutter A"

A second polycrystalline diamond element was produced, using a cemented carbide substrate having a profiled surface substantially as illustrated by FIGS. 4 to 6. The diamond mix used in producing the polycrystalline diamond table in this embodiment consisted of two layers. The mix of particles in the two layers was as described in respect of the particularly preferred embodiment above, and once again had a general thickness of about 2.2 mm. The average overall diamond particle size, in the polycrystalline diamond layer, was found to be 15 μm after sintering. This polycrystalline diamond cutter element will be designated "Cutter B".

Both of the polycrystalline diamond cutter elements A and B had catalysing material, in this case cobalt, removed from the working surface thereof to create a region lean in catalysing material. This region extended below the working surface to an average depth of about 40 to about 90 μm.

The leached cutter elements A and B were then compared in a vertical borer test with a commercially available polycrystalline diamond cutter element having similar characteristics, i.e. a region immediately below the working surface lean in catalysing material, although in this case to a depth of about 250 μm, designated in each case as "Prior Art cutter A". This cutter also does not have the high wear resistance PCD, optimised table thickness or substrate design of cutter elements of this invention. A vertical borer test is an application-based test where the wear flat area (or amount of PCD worn away during the test) is measured as a function of the number of passes of the cutter element boring into the work piece, which equates to a volume of rock removed. The work piece in this case was granite. This test can be used to evaluate cutter behaviour during drilling operations. The results obtained are illustrated graphically in FIGS. 7 and 8.

Figure 7:
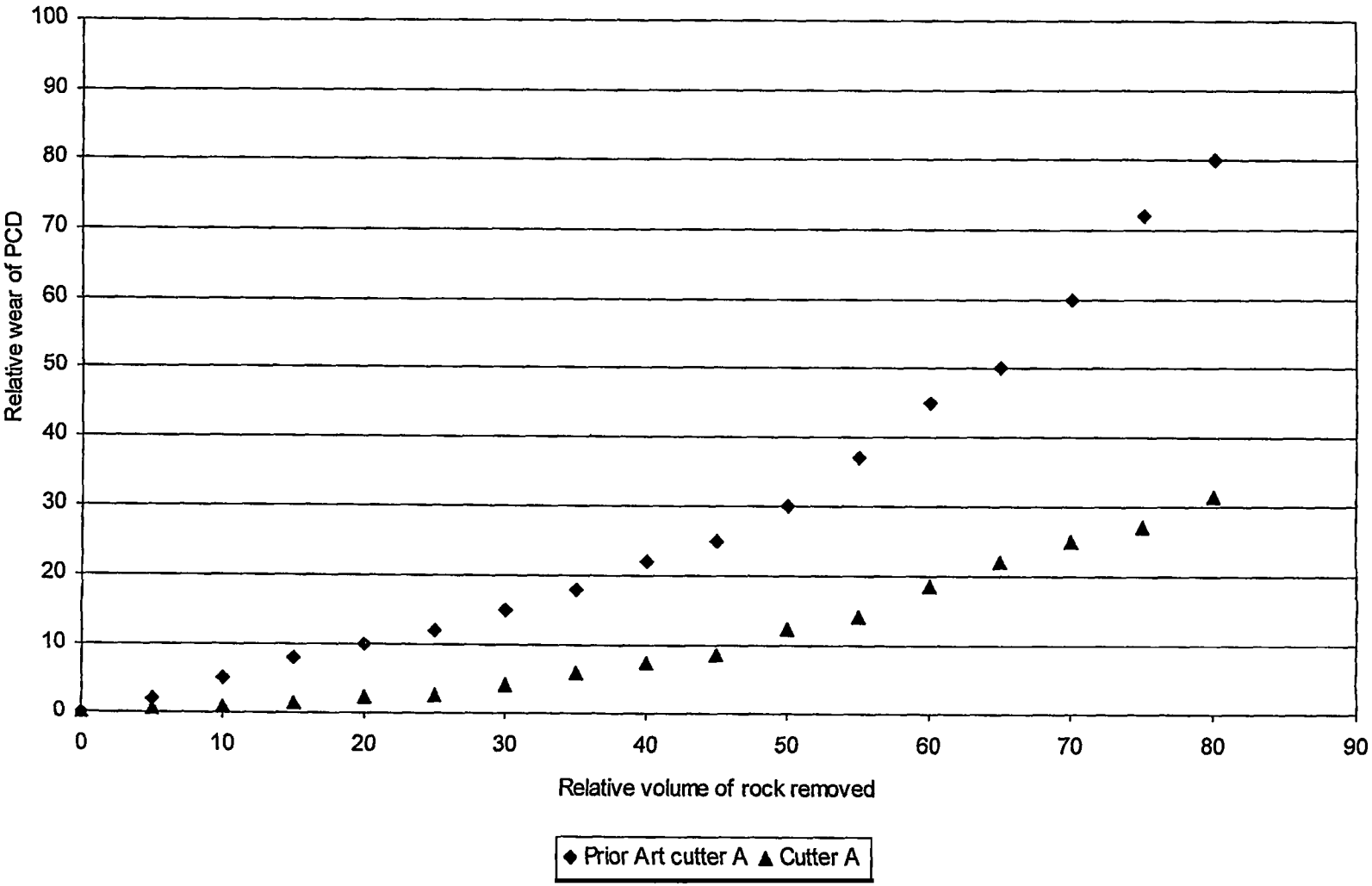
FIG. 7 is a graph showing comparative data in a first series of vertical borer tests using different polycrystalline diamond abrasive elements.

FIG. 7 compares the relative performance of Cutter A of this invention with the commercially available Prior Art cutter A. As this curve shows the amount of PCD material removed as a function of the amount of rock removed in the test, the flatter the gradient of the curve, the better the performance of the cutter. Cutter A shows a wear rate that compares very favourably with that of the prior art cutter.

Figure 8:
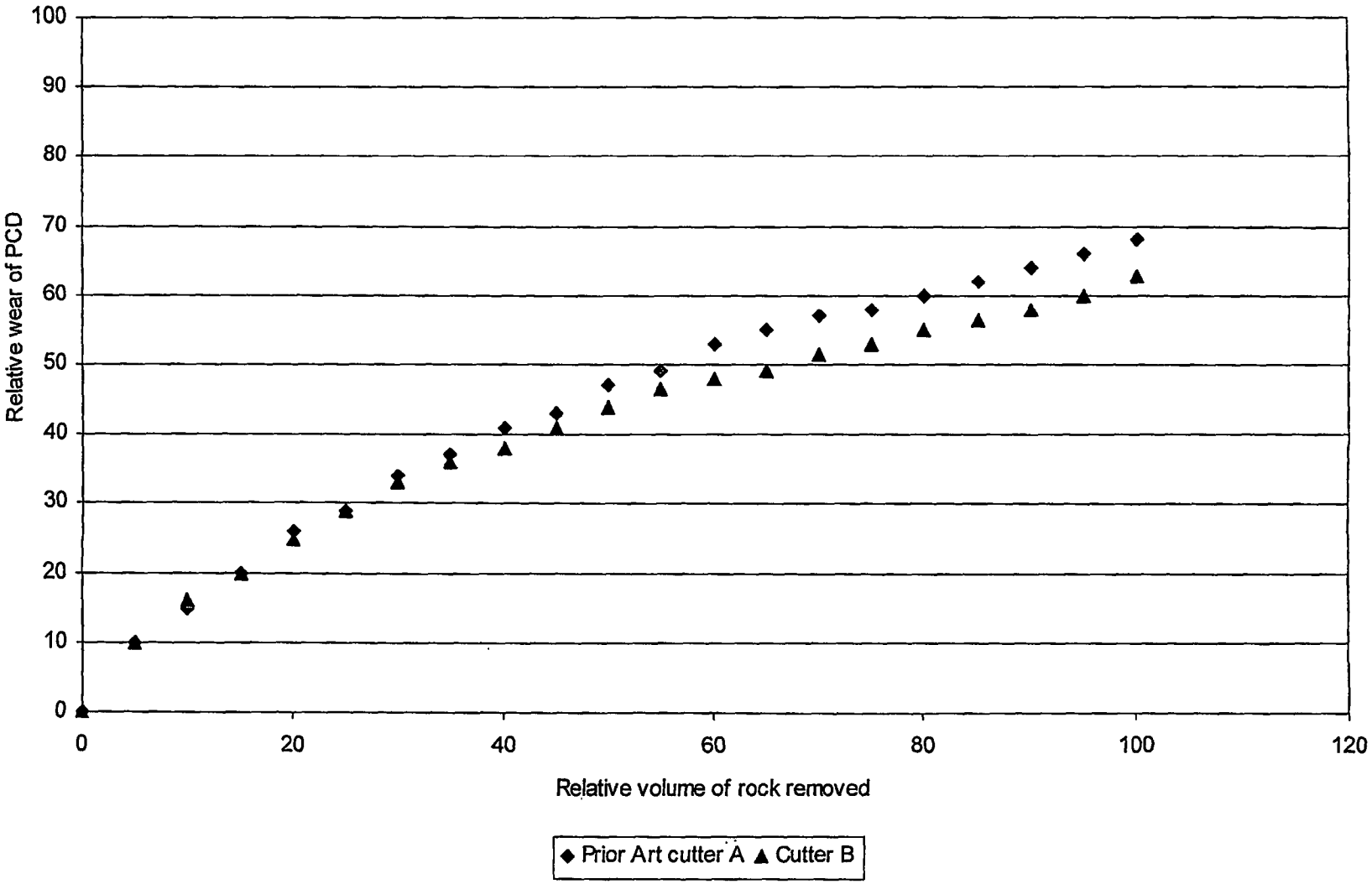
FIG. 8 is a graph showing comparative data in a second series of vertical borer tests using different polycrystalline diamond abrasive elements.

FIG. 8 compares the relative performance of Cutter B of the invention with that of the commercially available Prior Art cutter A. Note that this cutter also compares favourably with the prior art cutter.

The invention claimed is:

1. A polycrystalline diamond abrasive element, comprising a table of polycrystalline diamond having a working surface and bonded to a substrate along an interface, the polycrystalline diamond abrasive element being characterised by:

the interface being non-planar; and the polycrystalline diamond table having a region adjacent the working surface substantially free of catalysing material and a region rich in catalysing material, the region substantially free of catalysing material extending to a depth of no less than about 40 microns to 90 microns from the working surface.

2. An element according to claim 1, wherein the polycrystalline diamond table is in the form of a single layer and is produced from a mix of diamond particles having at least three different particle sizes.

3. An element according to claim 2, wherein the polycrystalline diamond layer is produced from a mix of diamond particles having at least five different average particle sizes.

4. An element according to claim 1, wherein the table of polycrystalline diamond comprises a first layer defining the working surface and a second layer located between the first layer and the substrate, the first layer of polycrystalline diamond having a relatively higher wear resistance than the second layer of polycrystalline diamond.

5. An element according to claim 4, wherein the first layer of polycrystalline diamond is produced from a mix of diamond particles having at least five different average particle sizes and the second layer is produced from a mix of diamond particles having at least four different average particle sizes.

6. An element according to claim 5, wherein the average particle size of the polycrystalline diamond is less than 20 microns and the average particle size of the polycrystalline diamond immediately adjacent the working surface is less than about 15 microns.

7. An element according to claim 4, wherein the average particle size of the polycrystalline diamond immediately adjacent the working surface is less than about 15 microns.

8. An element according to claim 1, wherein the polycrystalline diamond table has a maximum overall thickness of about 1 to about 3 mm.

9. An element according to claim 8, wherein the polycrystalline diamond table has a general thickness of about 2.2 mm.

10. An element according to claim 1, wherein the non-planar interface is configured with a cruciform recess consisting of only two, mutually perpendicular grooves extending into an upper surface of the substrate and intersecting at a center thereof.

11. An element according to claim 10, wherein the non-planar interface further comprises a step at a periphery of the abrasive element defining a ring which extends around at least a part of the periphery of the abrasive element and into the upper surface of the substrate and the cruciform recess intersects the ring and extends into the substrate at the ring to a depth greater than a depth of a base surface of the ring.

12. An element according to claim 10, wherein the non-planar interface further comprises a step at the periphery of the abrasive element defining a ring which extends around at least a part of the periphery of the abrasive element and into the upper surface of the substrate and the cruciform recess lies entirely within an upper flat central region of the upper surface of the substrate and is confined entirely within the upper flat central region of the upper surface of the substrate.

13. An element according to claim 12, wherein the ring includes a plurality of indentations in a base surface thereof, each indentation being located circumferentially adjacent and removed from a respective outer end of a groove of the cruciform recess.

14. An element according to claim 1, wherein the diamond abrasive element is a cutting element.

15. An element according to claim 1, wherein the substrate is a cemented carbide substrate.

16. A method of producing a polycrystalline diamond abrasive element including:

creating an unbonded assembly by providing a substrate having a non-planar surface;

placing a mass of diamond particles on the non-planar surface, the mass of diamond particles comprising at least three different average particle sizes;

providing a source of catalysing material for the diamond particles;

subjecting the unbonded assembly to conditions of elevated temperature and pressure suitable for producing a polycrystalline diamond table of the mass of diamond particles, such table being bonded to the non-planar surface of the substrate; and removing catalysing material from a region of the polycrystalline diamond table adjacent an exposed surface thereof to a depth of no less than about 40 microns to 90 microns.

17. A method according to claim 16, comprising producing the polycrystalline diamond table in the form of a single layer from a mass of diamond particles having at least five different particle sizes.

18. A method according to claim 16, further comprising producing the polycrystalline diamond table to comprise a first layer defining the working surface, and a second layer located between the first layer and the substrate, the first layer of polycrystalline diamond having a relatively higher wear resistance than the second layer of polycrystalline diamond.

19. A method according to claim 18, further comprising producing the first layer of polycrystalline diamond to comprise diamond particles having at least five different average particle sizes and the second layer to comprise diamond particles having at least four different average particle sizes.

20. A method according to claim 16, further comprising configuring the non-planar interface with a cruciform recess consisting of only two, mutually perpendicular grooves extending into an upper surface of the substrate and intersecting at a center thereof.

21. A method according to claim 20, further comprising providing the non-planar interface with a step at a periphery of the abrasive element defining a ring which extends around at least a part of the periphery of the abrasive element and into the upper surface of the substrate and the cruciform recess intersects the ring and extends into the substrate at the ring to a depth greater than a depth of a base surface of the ring.

22. A method according to claim 21, further comprising cutting the cruciform recess into an upper surface of the substrate and a base surface of the peripheral ring.

23. A method according to claim 20, further comprising providing the non-planar interface with a step at the periphery of the abrasive element defining a ring which extends around at least a part of the periphery of the abrasive element and into the upper surface of the substrate and positioning the cruciform recess entirely within an upper flat central region of the upper surface of the substrate and confined entirely within the upper flat central region of the upper surface of the substrate.

24. A method according to claim 23, further comprising providing the ring with a plurality of indentations in a base surface thereof, each indentation being located circumferentially adjacent and removed from a respective outer end of a groove of the cruciform recess.

25. A rotary drill bit containing a plurality of cutter elements, at least some of which are polycrystalline diamond abrasive elements, as defined in claim 1.

26. A polycrystalline diamond abrasive element, comprising a table of polycrystalline diamond having a working surface and bonded to a substrate along an interface, the polycrystalline diamond abrasive element being characterised by:

the interface being non-planar; and the polycrystalline diamond table having a region adjacent the working surface substantially free of catalysing material and a region rich in catalysing material, the region substantially free of catalysing material extending to a depth of no less than about 40 microns to 90 microns from the working surface, and wherein an average particle size of the polycrystalline diamond of the polycrystalline diamond table immediately adjacent the working surface is less than about 15 microns.

* * * * *